US005474476A

United States Patent [19]

Cheng

[11] Patent Number: 5,474,476

[45] Date of Patent: Dec. 12, 1995

[54] AUDIO/VIDEO CONNECTOR

[76] Inventor: Yu-Feng Cheng, No. 7, Fu Hsing St., Tu Chen Ind. Dist., Taipei Hsien, Taiwan

[21] Appl. No.: 337,374

[22] Filed: Nov. 8, 1994

[51] Int. Cl.[6] ..... H01R 17/04

[52] U.S. Cl. ..... 439/675; 439/874

[58] Field of Search ..... 439/96, 98, 610, 439/675, 578–580, 668, 874

[56] References Cited

U.S. PATENT DOCUMENTS

| | | | |
|---|---|---|---|
| 3,978,581 | 9/1976 | Miura | 439/675 |
| 4,129,352 | 12/1978 | Iizuka | 439/675 |

FOREIGN PATENT DOCUMENTS

| | | | |
|---|---|---|---|
| 2646735 | 9/1990 | France | 439/668 |
| 2085676 | 4/1982 | United Kingdom | 439/675 |

*Primary Examiner*—David L. Pirlot
*Assistant Examiner*—Jill DeMello
*Attorney, Agent, or Firm*—Parkhurst, Wendel & Rossi

[57] ABSTRACT

A connector includes a hollow prong, a grounding shell, an insulation base, and an electrical core. One end of the prong is centrally accommodated in the base and the grounding shell is peripherally mounted on the base with mounting tabs of the grounding shell engaging with notches of the base and thereby spacing the prong and the grounding shell apart. The electrical core has two wires. One of the wires is soldered to one of the mounting tabs and the other wire is soldered to the prong through an opening of the base.

2 Claims, 4 Drawing Sheets

AUDIO/VIDEO CONNECTOR

BACKGROUND OF THE INVENTION

1. Field of the Invention

The present invention relates to an audio/video connector and, more particularly, to an audio/video connector with an improved internal structure which is easier to be constructed.

2. Description of Related Art

A conventional audio/video connector structure, as shown in FIG. 4, generally consists of a prong 40, a grounding shield 50, and an electrical core 60. The grounding shield is peripherally mounted on a spacing plate 70 and the prong 40 centrally extends through the spacing plate 70 and is riveted to a base plate 80. The electrical core 60 has two wires, one of which being soldered to a bottom surface of the prong 40 and the other one being soldered to the outer surface of the grounding shield 50.

The audio/video connector has a main drawback of that the connections between the wires and the prong and the grounding shield are not reliable, because the bottom surface of the prong is rather small and special attention is needed when soldering a wire thereon and the outer surface of the grounding shield is smooth and arcuate causing the melted solder to flow on the surface and thus creating difficulty to solder a wire thereon. Both factors greatly affect the welding efficiency and connection reliability of the connector and, in turn, increase the manufacturing costs.

Therefore, there has been a long and unfulfilled need for a connector that is easier to be constructed and more reliable in use. The present invention provides an improved connector structure to mitigate and/or obviate the aforementioned drawbacks.

SUMMARY OF THE INVENTION

One object of the present invention is to present an improved connector structure that is easy to be manufactured and assembled.

Another object of the present invention is to present an improved connector structure with more stable and reliable performance.

The above-mentioned objects of the present invention are achieved by providing a connector which generally includes a hollow central prong having a closed end and an open end, a hollow cylindrical grounding shell, a base made of an insulation material, and an electrical core.

The grounding shell comprises a plurality of mounting tabs protruding axially at one end thereof and equally spaced around the periphery of the end.

The base comprises a top plate and a stud. The top plate comprises a circular protrusion projecting from the upper surface thereof and a plurality of notches equally spaced around periphery thereof. The protrusion has an outer diameter which is equal to an inner diameter of the grounding shell but smaller than the diameter of the top plate for mounting the grounding shell onto the base with the tabs engaging with the notches. The top plate further comprises a circular recess at the central portion thereof with a peg centrally located therein defining an annular space for receiving the open end of the prong. The stud is located at a lower surface of the top plate and has an opening adjacent to the top plate and in communication with the annular space.

The electrical core has two wires, one of the wires being soldered to the prong through the opening and the other one being soldered to one of the tabs.

In accordance with one embodiment of the present invention, the bulge to which a wire is soldered further comprises a hole for the wire to extend therethrough and around the tab and then soldered thereon, thereby providing a stronger connection therebetween.

In accordance with the same embodiment of the present invention, the central prong is pressed against the peg through the opening, before welding a wire thereon, for more securely holding the wire in the recess.

In accordance with another embodiment of the present invention, the stud comprises more than one opening in communication with the annular space and the central prong is pressed against the peg through the openings whereby providing a uniform securing force.

Other objects, advantages, and novel features of the invention will become more apparent from the following detailed description when taken in conjunction with the accompanying drawings.

BRIEF DESCRIPTION OF THE DRAWINGS

FIG. 3A is an assembled perspective view of the Audio/Video connector shown in FIG. 1; and.

DETAILED DESCRIPTION OF THE PREFERRED EMBODIMENTS

Figure 1:
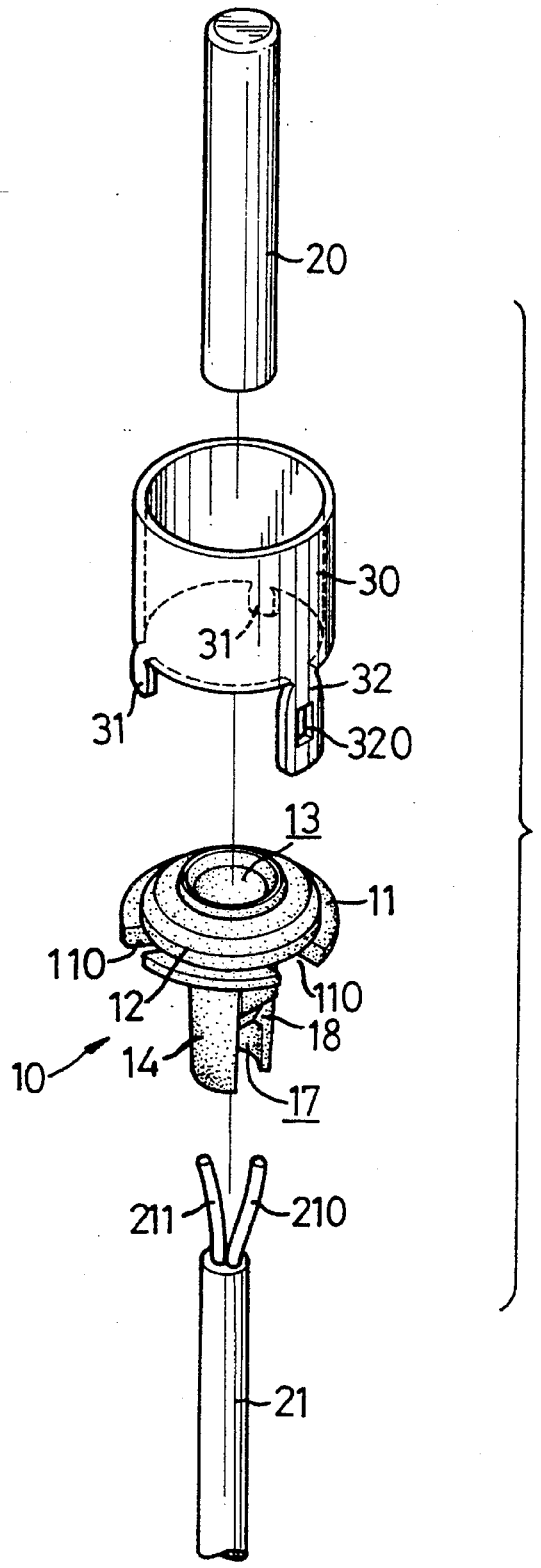
FIG. 1 is an exploded perspective view of an embodiment of a connector in accordance with the present invention.
Figure 2:
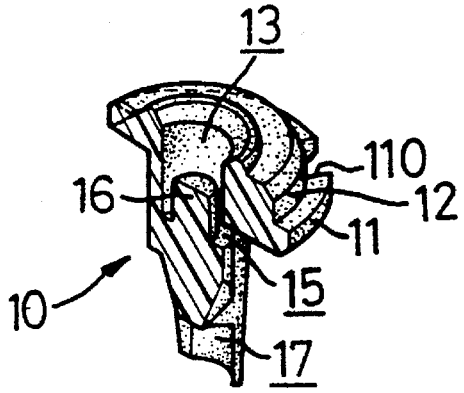
FIG. 2 is a perspective view, partly in section, of a base showing the internal configuration thereof.
Figure 3:
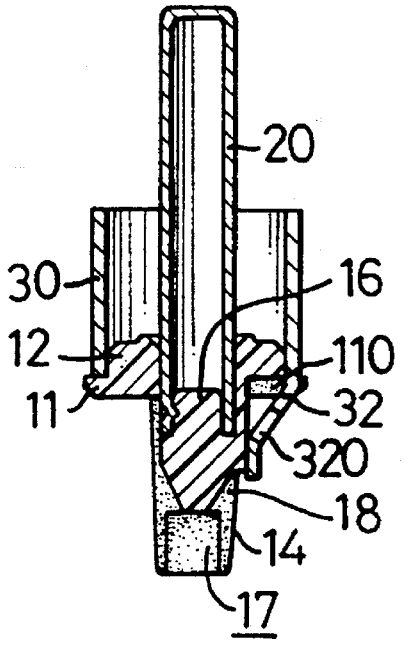
FIG. 3 is a cross-sectional view of an assembled connector in accordance with the present invention.

Referring to FIGS. 1 to 3, the connector in accordance with the present invention generally includes a central prong 20, a grounding shell 30, a base 10 and an electric core 21.

The base 10 comprises a top plate 11 and a stud 14. The top plate 11 comprises a disk shape protrusion 12 having an outer diameter smaller than the top plate 11 and projecting upwardly at the top surface thereof. The top plate 11 further comprises three notches 110 equally spaced around a periphery edge thereof. Further, a cylindrical recess 13 is defined at the central portion of the top plate 11 with a peg 16 centrally located therein to define an annular space in the recess. The stud 14 has a recess 17 at its distal end and a longitudinal aperture 18 along part of its periphery. Further, there is an opening 15 transversely defined adjacent to and below the top plate 11 and in communication with the annular space defined in the recess 13.

The central prong 20 is hollow with a closed end and an open end and the open end is inserted in the recess 13. Preferably, the central prong 20 is pressed onto the peg 16 through the opening 15 and thereby securely held in place, as shown in FIG. 3. Alternatively, there can be more than one opening 15 of the stud 14 and the central prong 20 is pressed through the openings to provide a uniform securing force to the central prong 20. The grounding shell 30 is a hollow cylinder having an inner diameter the same as the outer diameter of the protrusion 12 and two mounting tabs 31 and an ear 32 protruding axially at one,end thereof. The ear 32 and the two mounting tabs 31 are equally spaced around the periphery of the end and the ear 32 further has a hole 320 defined therein. The grounding shell 30 is mounted on the protrusion 12 with the two mounting tabs 31 and the ear 32 interlocking with the notches 110 and, for firmly mounted thereon, the tabs and ear are folded inwardly to hold onto the top plate.

Figure 3A:
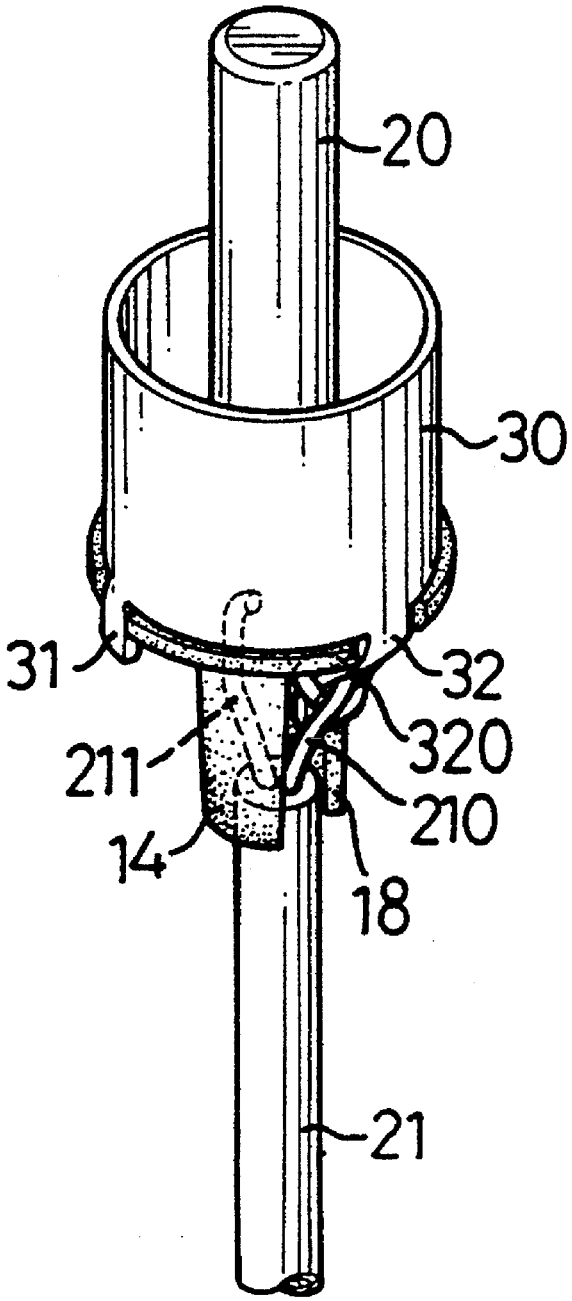
Figure 4:
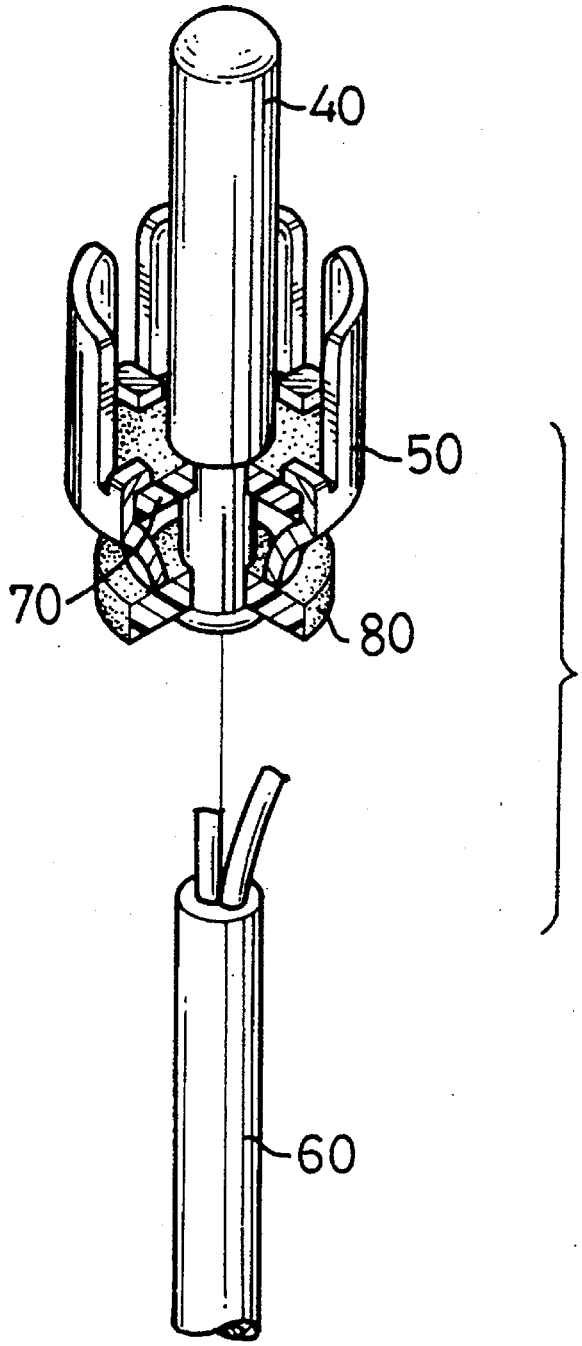
FIG. 4 PRIOR ART
FIG. 4 is a perspective view of a prior art connector.

The electric core 21 is received in the recess 17. Two wires, 211 of the core 21 extend from the recess 17 via the groove 18, one of which is soldered to the central prong 20 through the opening 15 and the other one extends through the hole 320, around the ear 32 and then is soldered to the ears, shown in FIG. 3A.

Although the invention has been explained in relation to its preferred embodiment, it is to be understood that many other possible modifications and variations can be made without departing from the spirit and scope of the invention as hereinafter claimed.

I claim:

1. A connector comprising:

a hollow central prong having a closed end and an open end;

a hollow cylindrical grounding shell comprising a plurality of mounting tabs including a first tab, protruding axially from one end of the grounding shell and being equally spaced around periphery of said one end, said first tab including a hole therein a base comprised of insulation material, including (i) a top plate having a circular protrusion projecting from an upper surface thereof, and a plurality of notches equally spaced around a periphery thereof, the protrusion having an outer diameter which is equal in size to an inner diameter of the grounding shell but smaller than a diameter of the top plate for mounting the grounding shell onto the base such that the tabs engage the notches, and (ii) a stud extending from a lower surface of the top plate, said stud having a lateral opening in an upper periphery thereof, wherein said base includes a cylindrical recess which extends through a central portion of the top plate and to said stud such that the lateral opening is in communication with said cylindrical recess, said cylindrical recess having a peg centrally located therein thereby defining an annular space receiving the open end of the central prong; and an electrical core having two wires, one of the wires extending through the lateral opening and being soldered to the central prong, the other wire extending through the hole in the first tab and being soldered to the first tab.

2. The connector as claimed in claim 1, wherein a peripheral wall of the central prong is laterally pressed against the peg in the opening, thereby forming an indentation in the peripheral wall such that said one of the wires is securely soldered onto the central prong.

* * * * *